US007089685B2

(12) United States Patent
Torgovnikov et al.

(10) Patent No.: US 7,089,685 B2
(45) Date of Patent: Aug. 15, 2006

(54) METHOD OF MICROWAVE TREATMENT OF WOOD

(75) Inventors: Grigory Torgovnikov, Creswick (AU); Peter Vinden, Creswick (AU)

(73) Assignee: The University of Melbourne, Parkville (AU)

( * ) Notice: Subject to any disclaimer, the term of this patent is extended or adjusted under 35 U.S.C. 154(b) by 0 days.

(21) Appl. No.: 10/481,172

(22) PCT Filed: May 28, 2002

(86) PCT No.: PCT/AU02/00676

§ 371 (c)(1),
(2), (4) Date: Dec. 17, 2003

(87) PCT Pub. No.: WO03/002923

PCT Pub. Date: Jan. 9, 2003

(65) Prior Publication Data

US 2004/0178193 A1 Sep. 16, 2004

(30) Foreign Application Priority Data

Jun. 27, 2001 (AU) ..... PR5963

(51) Int. Cl.
*F26B 3/34* (2006.01)

(52) U.S. Cl. ..... 34/265; 34/396

(58) Field of Classification Search ..... 34/245, 34/259, 264, 265, 396
See application file for complete search history.

(56) References Cited

U.S. PATENT DOCUMENTS 3,872,603 A * 3/1975 Williams et al. ..... 34/265
4,377,039 A * 3/1983 Hager ..... 34/263
4,471,688 A * 9/1984 Smets ..... 454/191
5,195,251 A * 3/1993 Gyurcsek et al. ..... 34/489
5,779,844 A * 7/1998 Lewis et al. ..... 156/275.5
5,977,532 A * 11/1999 Ekemar ..... 219/748
6,029,368 A * 2/2000 Banerjee et al. ..... 34/255

FOREIGN PATENT DOCUMENTS

WO WO 99/64123 * 12/1999

* cited by examiner

*Primary Examiner*—S. Gravini

(74) *Attorney, Agent, or Firm*—Dorsey & Whitney LLP; David J. Brezner

(57) ABSTRACT

A method of microwave treatment of wood with a moisture content (based on dry weight) of at least 12% for rapid drying and stress relief which includes determining an area of the wood that is not to be treated, selectively subjecting a surface of the wood outside said determined area to microwave radiation at a frequency (f) in the range of from about 0.1 to about 24 GHz to provide a modified wood zone having increased permeability relative to the untreated wood, wherein said zone is located in an exterior shell of the wood and has wooden rays directed from the core of the wood to the irradiated surface.

25 Claims, 3 Drawing Sheets

METHOD OF MICROWAVE TREATMENT OF WOOD

CROSS-REFERENCE TO RELATED APPLICATIONS

This is an application filed under 35 U.S.C. § 371 of International Application No. PCT/AU02/00676, filed May 28, 2002, which claims the benefit under 35 U.S.C.§ 365(c) of Australian Patent Application No. PR5963, filed Jun. 27, 2001.

FIELD OF THE INVENTION

The present invention relates to the treatment of wood, and is particularly concerned with a method of microwave treatment of wood, especially moist wood for rapid drying and stress relief.

BACKGROUND

The treatment of wood by impregnating it with preservatives and other agents, such as for fire-proofing, is very well known. One of the problems of the impregnation treatment is ensuring that the agent has impregnated the wood fully or at least sufficiently.

It is also known to prepare wood for impregnation by using steam to raise the temperature and pressure in the wood and break down some of the wood cells (after the pressure is rapidly reduced) and thereby to improve the natural permeability of the wood. Updated steaming specifications for, for example, round wood radiata pine steam conditioning recommend the use of steam at a temperature of 127° C. and pressure of 138 kPa for a period of from 1.5 to 18 hours depending upon the thickness of the wood before the pressure is rapidly reduced. While this treatment does help to improve the impregnation process, it has several disadvantages, particularly the duration of the treatment and the requirement for high pressure steam.

It is also known to dry wood and to form fibres by destroying the wood structure using microwave energy. It is important in drying the wood using microwave energy not to damage the wood and special drying schedules have been proposed for different wood species. In all of these schedules the microwave radiation intensity is very low, below 5 to 10 $W/cm^2$, in order to avoid damage to the wood.

Destruction of wood using microwave energy to form fibres is performed at a considerably higher radiation intensity, for example up to 150 $kW/cm^2$, with the aim of heating the moisture in the wood to form steam very quickly and in sufficient quantity to entirely break down the structure of the wood.

International Patent Publication No. WO99/64213 discloses a method which comprises subjecting wood to microwave radiation to cause water in the wood to vaporise resulting in an internal pressure in the wood such that the permeability of the wood is increased by partial or complete destruction of ray cell tissue, softening and replacement of wood resin, formation of pathways in the radial direction of the wood and/or by creating, on the base of destroyed rays, cavities in the wood, said cavities being primarily in radial-longitudinal planes of the wood. This reference also suggests that the microwave modified timber can have regions of different permeability which can alternate in radial, tangential and longitudinal directions.

The use of this method for pre-drying treatment may lead to 6–25% reduction of strength properties of the timber. As such, in some cases it is not adoptable. For example, the working side of parquet boards must have high hardness. After the MW treatment considered by the above prior art, that surface may lose its hardness to an extent which would make it unsuitable for use as an exposed surface.

During the MW treatment of large cross section sawn timber the core is heated faster than the shell (if supplying MW energy to the timber from all sides). As such, the vapour pressure may be high in the core, but the surface layers still may have no pathways in the radial directions for releasing vapours created in the core. This situation leads to the appearance of big checks in shell layers of the timber which spoil the material.

The growth and shrinkage stresses which take place in the wood may lead to losses of timber and may also lower the quality of the material. For example, during wood drying the shrinkage in the tangential direction is much higher compared with the shrinkage in the radial direction. Therefore, back-sawn lumber may experience cupping (transverse warping) after drying.

These shortcomings are advantageously alleviated using the method of microwave treatment according to the invention.

SUMMARY OF THE INVENTION

According to one aspect of the present invention there is provided a method of microwave treatment of wood with a moisture content (based on dry weight) of at least 12% for rapid drying and stress relief which includes determining an area of the wood that is not to be treated, selectively subjecting a surface of the wood outside said determined area to microwave radiation at a frequency (f) in the range of from about 0.1 to about 24 GHz to provide a modified wood zone having increased permeability relative to the untreated wood, wherein said zone is located in an exterior shell of the wood and has wooden rays directed from the core of the wood to the irradiated surface.

There is also provided wood whenever treated by the method described in the immediately preceding paragraph.

In one embodiment, a plurality of zones located in the exterior shell of the wood are treated by the microwave treatment. Further, if the wood is relatively thick, then the process may include a further step of treating a core volume of the wood with a microwave, preferably of lower frequency to that used to treat the zone or zones of the exterior shell. In the case where a two step process is employed, firstly to treat zone(s) of the exterior shell of the wood, and subsequently to treat the core volume, the electric field strength vector E is advantageously oriented parallel to the wood grains for irradiation of the exterior shell zone(s) and primarily perpendicular to the wood grains for irradiation of the core volume. It will be understood that still further treatment stages or steps may be implemented depending on the thickness of the wood being treated. In some embodiments the wood is treated to provide alternating treated and untreated zones in the exterior shell of the wood along the length of the wood and across the width and depth of the wood.

The areas which remain untreated are those which require, or at least it is desirable that they have, the original hardness and or strength of the untreated wood. For example, for parquet boards it is important that the exposed surface in use be untreated. In other applications where vertical load will be applied to the final product, it may only be suitable to treat central regions disposed along longitudinal edges of lumber.

The treatment preferably includes the application of a microwave with a power intensity (p) from about 10 W/cm$^2$ to about 100 kW/cm$^2$ for a duration of from about 0.05 to about 600 seconds to cause water in the zone(s) of the exterior shell of the wood to vaporise resulting in an internal pressure in the zone(s) of the wood such that the zones are modified.

DETAILED DESCRIPTION OF THE INVENTION

The microwave treatment of the present invention modifies the zones of the exterior shell of the wood typically by vaporising water contained in the wood to create an internal pressure and a temperature above 100° C. resulting in the modification of the wood structure by any one or more of the destruction of ray cells in the wood, softening and mobilising of the resin in the wood and replacing it at least partially with open pores, and the creation of thin radial checks, resulting in cavities disposed mainly in radial-longitudinal planes. There may be no substantial drying of the wood during the process of the invention. The present invention may facilitate in-line processing of wood for fast drying. That is, the thin radial checks or cavities may allow faster subsequent drying treatments than compared with the drying techniques conventionally employed in the absence of the treatment of the present invention. For example, hard wood species (i.e. refractory woods), such as eucalypts, may experience internal checking and collapse upon fast drying without the prior treatment of the present invention due to excessive pressure build up within the wood.

The microwave treatment of the present invention is not necessarily limited to subjecting the wood to a single microwave frequency or power intensity. The method may comprise, for example, subjecting the wood to various microwave frequencies and power intensities in a single treatment. Preferably, the power intensity, whether a single power intensity or a number of different power intensities are used, is maintained at not less than 10 W/cm$^2$. In a preferred embodiment, however, the power intensity is maintained above 10 W/cm$^2$.

The microwave treatment of the present invention may use energy impulses of predetermined duration and separated by set time intervals to treat the wood. Alternatively, microwaves may be directed at a portion or portions of wood to be treated. If a plurality of zones of the external shell are to be treated, these are selected in a predetermined manner, generally with the proposed use of the final product in mind. That is, depending on the required flexibility, strength, permeability and other required characteristics of the product.

The process of the present invention is preferably applied to the treatment of moist wood. As used herein and throughout the specification the term "moist wood" refers broadly to wood which is "green" after sawing as would be understood by a person skilled in the art. The amount of water present in the moist wood will, of course, vary depending on the species of plant, but it is considered that moist wood will generally have a moisture content in the range of from about 30 to about 200% based on the dry weight of the wood. The process of the present invention is also applicable to the treatment of wood having lower moisture contents, such as from 12% to 30%.

Wood is capable of absorbing very high quantities of microwave energy. The microwave energy causes the water in the cells of the wood to heat up and boil, creating steam pressure in the cells which results in the destruction of cell walls. The ray cells have thinner walls than the cells of the main wood tissues (tracheids, libriform) and ray cells are destroyed by the microwave energy before cells of the main wood tissue. The destroyed ray cells form paths in the radial direction for the easy transportation of liquids and vapours inwardly from the outer surface. Ray cells form from about 5 to about 35% of the wood volume, so their destruction may increase the wood permeability substantially.

The treatment advantageously results in the destruction of ray cells in the selected zone(s) while substantially maintaining the overall integrity of the wood. That is, the destruction of the ray cells may occur without significant destruction of cells of the main wood tissues (commonly referred to as the grains or fibres of the wood).

As discussed above, increasing the intensity of microwave energy supplied to the wood increases the steam pressure therein to the extent of ray volume that the tracheid (libriform) walls begin to rupture. The tensile strength of wood is two to three times less in the tangential direction than in the radial direction and with increased internal pressure, for example corresponding to increased intensity of microwave energy, the wood in the treatment zone(s) may be destroyed along the main wood tissues. This results in checks which extend in the radial-longitudinal planes. Furthermore, as the tensile strength of the wood in the tangential direction reduces, as the temperature (and pressure) increases, the checks may be formed in the wood at comparatively low pressures.

When subjected to microwave energy, any resin in the zones of the wood softens before melting and boiling. Steam pressure in the wood forces the soft resin to be displaced from rays, leaving pores or cavities in the zones of the modified wood. This is a particularly effective means of increasing the permeability of wood having substantial quantities of resin.

The microwave treated zones of timber may have three degrees of modification:

- "low degree"—including rupturing wooden cell pore membranes, resin melting and replacement in channels, partly rupturing ray cells.
- "moderate degrees"—including rupturing wooden cell pore membranes, resin boiling and replacement, destroying tyloses (in hardwood species) and rupturing ray cells,
- "high degree"—including rupturing wooden cell pore membranes, resin boiling and replacement, destroying tyloses (in hardwood species), rupturing ray cells, rupturing main cell (traheids libriform) walls and vessels and formation of cavities being primarily in radial-longitudinal planes.

Low, moderate or high degree of wood modification can be used for stress relief and pre-drying treatment depending on requirements to the product.

The present invention substantially maintains the integrity or overall structure of the wood, but provides increased permeability in treated zones which may enhance subsequent treatments, particularly fast drying of the wood. The range of microwave frequencies suitable for the wood treatment is limited to from about 0.1 GHz to about 24 GHz. It is impossible at a frequency less than about 0.1 GHz to create sufficient energy in the wood to destroy the cell walls because, at the required power density, electric breakdown (punch-through) takes place and the wood is carbonized. At a frequency greater than about 24 GHz, the penetration depth of microwaves in moist wood may be less than about 10 to 15 mm. This generally will not permit sufficient distribution of energy (temperature) to provide the desired effects. Further, if it is desired to treat zones of the external shell of the wood, then generally a frequency of from 2.4 to 24 GHz is applied, whereas for core treatment a frequency of from 0.1 to 1.0 GHz is applied.

The desired power intensity will vary with the selected microwave frequency. At a frequency of about 24 GHz, it is sufficient for the microwave intensity to be about 10 W/cm$^2$. However, at a microwave frequency of about 0.1 GHz, up to 100 kW/cm$^2$, preferably up to 50 kW/cm$^2$, and more preferably up to 12 kW/cm$^2$ may be required for rapid heating and destruction of the wood cells. Preferred ranges of microwave frequency (f) and power intensity (p) are from about f=0.4 GHz and p=12 kW/cm$^2$ to about f=10 Ghz and p=0.48 kW/cm$^2$, more preferably from about f=1 GHz and p=6 kW/cm$^2$ to about f=6 GHz and p=1.0 kW/cm$^2$.

The duration of the microwave treatment within the defined frequency and power intensity ranges is preferably in the range of from 0.05 to 600 seconds, more preferably 0.1 to 600 seconds, and will generally be less than 250 seconds, preferably less than 100 seconds, more preferably from about 1 to about 20 seconds. The minimum duration of the microwave treatment to increase the permeability of the wood is determined by the power of the microwave generator(s) used. The maximum capacity generator used in the timber industry is generally 500 kW. Experiments have shown the highest excessive pressure in the wood for making the radial-longitudinal checks must be about 400 kPa, and from a practical point of view it is difficult to create conditions for increasing the wood permeability during a period of less than 0.05 seconds. A microwave wood treatment of greater than 600 seconds is unlikely to produce good quality wood for further treatment, but longer periods may be used with combinations of very low microwave frequency and power intensity. However, commercially such long periods will not usually be acceptable.

To achieve wood modification (for example improvements in permeability) in different zones in the wood advantageously microwave radiation of different frequencies is used. For example, if timber has a cross-section of 100×100 mm, microwave modification may be achieved using a frequency of 2.4 GHz. The wood may subsequently be modified to a depth of 20 mm in which the modification is restricted to the ray cells. If a frequency of 0.915 GHz is employed, modification in the central zone of the wood may be effected by modification or destruction of the ray cells and formation of a number of cavities in the radial-longitudinal planes.

Wood cells have a maximum absorption of microwave energy if the electric field strength vector E is oriented parallel to the length of the cell. Rays are generally aligned in the radial direction (perpendicular to the main wood tissues (tracheids, libriform) so that the ray cells will have a maximum microwave energy absorption when vector E is oriented in the radial direction. With the vector E orientation parallel to the rays and perpendicular to the main wood tissues, the ray cells will heat faster than the other tissues of the wood and absorb more energy which permits the destruction of the ray cells without the destruction of the main wood tissues. The present process may also enable a reduction in energy consumption.

The dielectric properties of wood are dependent upon the vector E orientation to the main wood tissue direction. The dielectric loss factor of moist wood when vector E is oriented parallel to the main wood tissues has a value about 1.6 to 2.2 times higher than when vector E is oriented perpendicular to the tissues. Furthermore, the microwave penetration depth decreases about 1.5 to 2 times when the orientation of vector E is changed from perpendicular to the main wood tissues to parallel to the tissues, and the absorption ability of wood increases correspondingly. Accordingly, the effects of applying the microwave energy to the wood can be controlled by moving the vector E orientation between the preferred perpendicular direction to the wood tissues and parallel to the wood tissues.

The use of microwave energy for increasing permeability is most efficient at elevated temperature, and advantageously the method of the invention is performed at a wood temperature of about 80 to about 110° C., preferably about 90 to about 100° C. The wood may be heated by any suitable means, for example by convection, contact or electroconductive methods. Advantageously the wood is heated by means of microwave energy, for example at a frequency range of about 0.1 to about 24 GHz with a power intensity of from about 0.1 to about 10 W/cm$^2$. The microwave preheating may be carried out over any suitable period, for example from about 20 to about 600 seconds.

In order to increase the effect of the selective influence of microwave energy on ray cell destruction or resin softening, it may be advantageous at wood temperatures above about 100° C. to use energy impulses with high energy density. This may help to avoid overheating the body of the wood.

During high intensity microwave treatment, the surface of timber may be overheated and carbonised. To alleviate this, it is desirable to cool the surface using gas or air flow, preferably at speeds of not less than 1 m/sec, more preferably not less than 2 m/sec. Applying gas or air flow to the surface of the wood may also advantageously remove vapours, dust and moisture from the zone of irradiation and may also avoid moisture condensation in the microwave applicator.

The increase in permeability of the zones of the wood-based material when treated compared with the untreated wood may be quite marked. The integrity of the untreated wood is maintained in the wood-based material produced in accordance with the invention. Furthermore, as discussed above, there is no significant destruction of cells of the main wood tissue in the wood-based material. However, there will generally be a reduction in mechanical properties of the treated zones of the wood-based material compared with those of the untreated areas of the wood. In particular, it can be expected that the treated zones of the wood-based material will have decreased modulus of elasticity (MOE) and decreased modulus of rupture (MOR) compared with the untreated wood.

A very important application of this method relates to its use for reduction of growth stresses in wood. That is, the present method may also be used to reduce growth stresses in logs or sawn timber. In this case, zones (selective areas) with high growth stresses in cross section and on the length of the log can be microwave treated in one, two or more stages at different intensities and frequencies. The relief of growth stresses in logs will advantageously improve lumber quality and recovery. Experiments with eucalypt posts have shown that microwave treatment can prevent post splitting and maintain the posts integrity.

The present invention is suitable for round wood, lumber, beams and other timber and blanks of different forms. The method of modifying wood can be used before any drying of the wood. The method is suitable for any species of wood, but is especially suitable for hard drying species with a high volume of ray cells, such as English oak or Messmate.

Embodiments of the present invention will now be further described by way of example with reference to the accompanying drawings in which.

Figure 1:
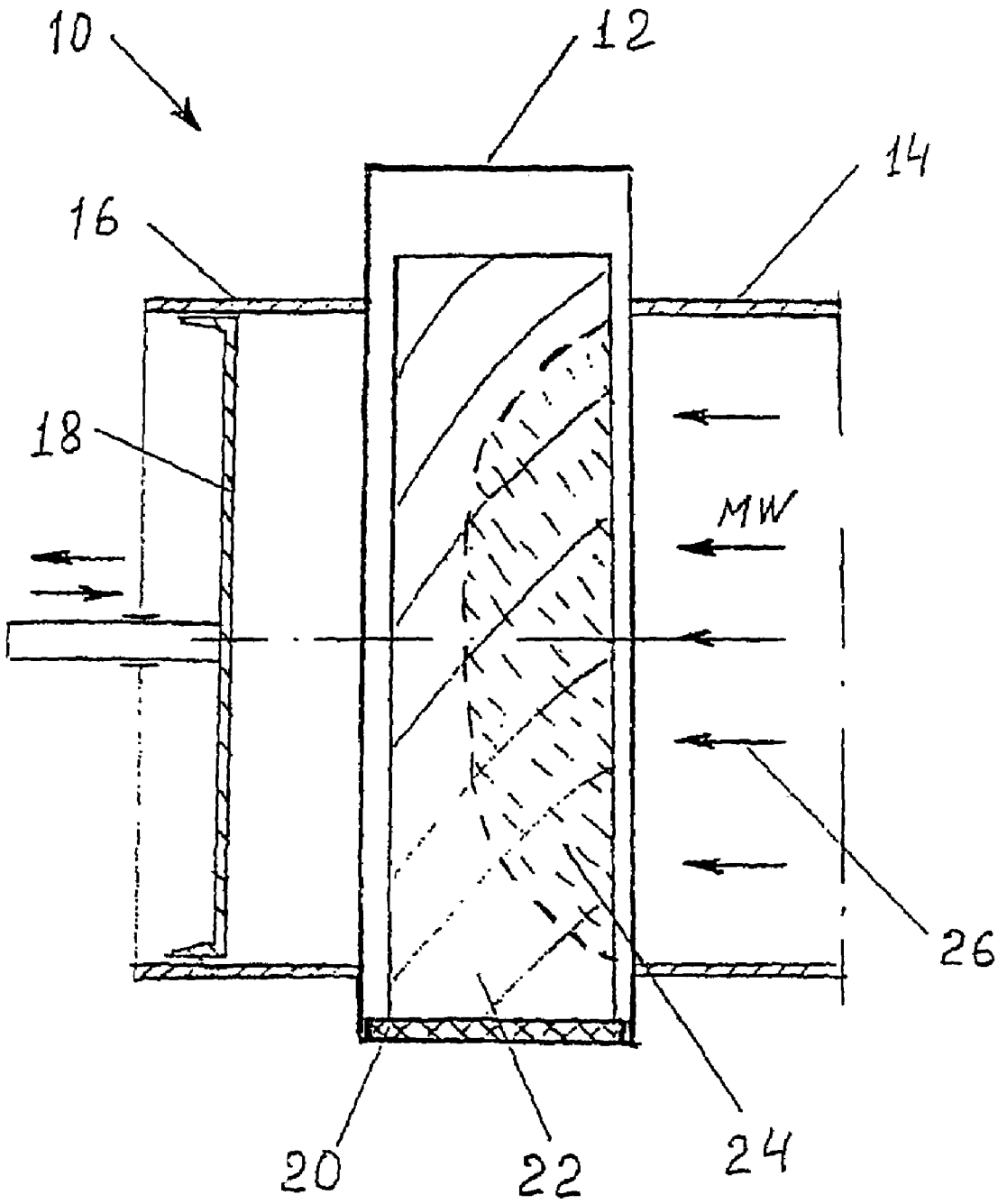
FIG. 1 is a schematic view of apparatus for performing the process of the invention to increase the wood permeability of one side of a board.

Referring to FIG. 1, apparatus 10 comprises a tunnel 12 connected with a waveguide 14 opened in the tunnel 12 for supplying microwaves. A waveguide 16 also is connected with tunnel 12 and contains a short-circuiting piston 18 for control of microwave reflection. A wood board 22 passes through the tunnel 12 on conveyor belt 20. The dotted line marks a zone of modified wood with high permeability following treatment.

The board 22 is conveyed by the conveyor belt along the tunnel 12 at a predetermined speed to give the desired treatment time opposite the waveguide 14. The waveguide 14 directs microwaves perpendicular to the length of board as shown by arrow 26. Electric strength vector E is oriented parallel to the length of the board and wooden grain. The piston 18 can be moved in the waveguide 16 to change microwave energy distribution in the board cross section.

Figure 2:
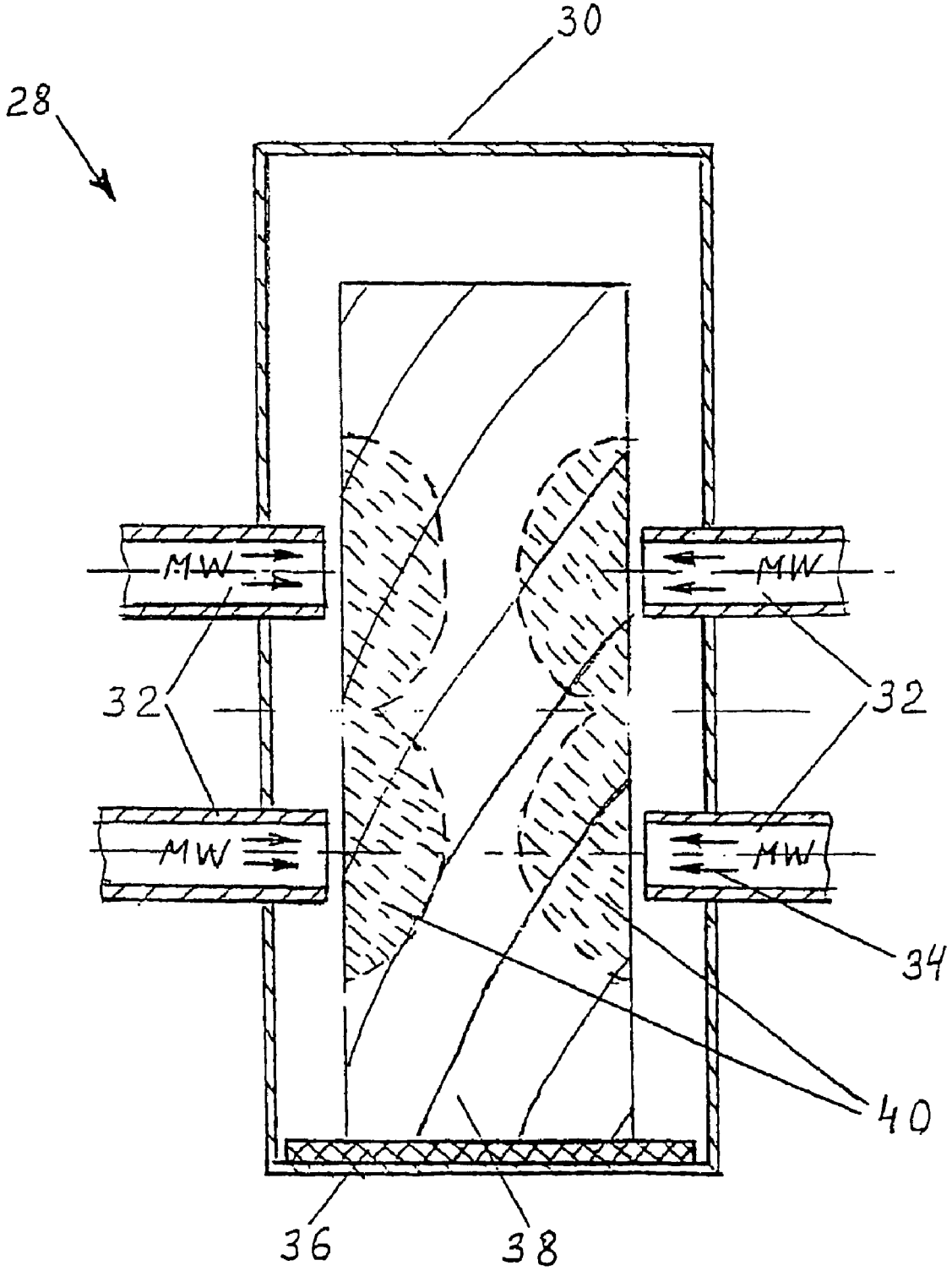
FIG. 2 is a schematic view of apparatus for performing the process of the invention to increase the wood permeability of two sides of a board.

Referring to FIG. 2, the apparatus 28 comprises a tunnel 30 in which four waveguide radiators 32 are mounted to supply microwaves to the tunnel as shown by arrows 34. A conveyor belt 36 moves the board 38 along the tunnel 30. The dotted lines mark zones 40 of modified wood with high permeability following treatment.

The board 38 is conveyed by the conveyor belt along the tunnel 30 at a predetermined speed to give the desired treatment time opposite the waveguide radiators 32. Four radiators 32 direct microwaves perpendicular to the length of board 38. Electric strength vector E is oriented perpendicularly to the length of the board and wooden grain.

Figure 3A:
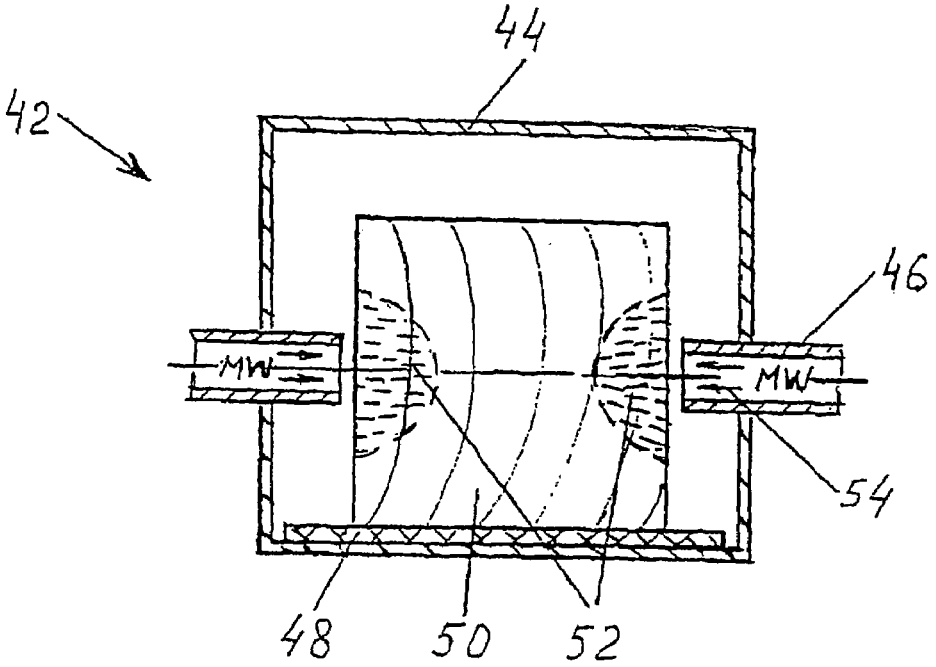
FIGS. 3A and 3B are a schematic view of apparatus for performing the process of the invention to modify wood in two stages.
Figure 3B:
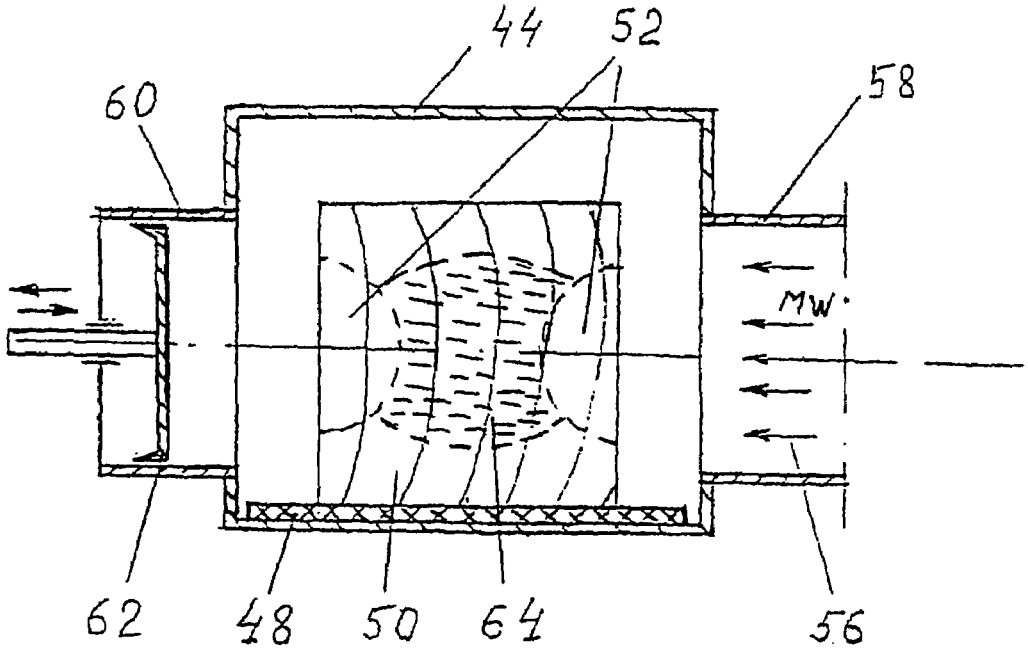

Referring to FIG. 3 the apparatus 42 comprises a tunnel 44 connected with waveguides 46 and 58 opened in a tunnel 44 for supplying microwaves. The waveguide 60 is also connected with tunnel 44 and contains a short-circuiting piston 62 for the control of microwave reflection. The lumber 50 is placed on the conveyor belt 48. The dotted lines mark zones 52 and 64 of modified wood with high permeability following treatment.

The lumber 50 is conveyed by the conveyor belt along the tunnel 44 at a predetermined speed to give the desired treatment time opposite the waveguides 46 and 56. The waveguides 46 and 56 direct microwaves perpendicular to the length of the block as shown by arrows 54 and 56. Electric field strength vector E is oriented perpendicular to the length of the block and wooden grain in waveguides 46 and 58. The piston 62 can be moved in the waveguide 60 to change microwave energy distribution in the lumber cross section.

The invention will now be described in more detail with reference to the following Examples which are illustrative of the invention only and which should not be taken as limiting on the invention in any way.

EXAMPLE 1

This Example relates to the microwave pre-treatment of Messmate parquet boards of cross section 25×92 mm for subsequent fast drying in a convectional kiln. One side of the boards must have high hardness and minimum drying defects in the surface layers. Initial wood moisture content was 90%.

For pre-treatment the board was placed on a conveyer belt 20 as shown on FIG. 1 and moved along the tunnel 12. Microwave energy was supplied to the timber through the waveguide 14 as shown by arrows 26. Process parameters: microwave frequency —0.922 GHz, electric field strength vector E orientation—parallel to wooden grain, average power intensity 280 W/cm$^2$, conveyor speed—6.3 mm/s.

Microwave irradiation required to vaporise water contained in a zone of the external shell of the wood and to create internal pressure and a temperature above 100° C. in that zone of the wood was applied resulting in modification of the wood structure by destroying ray cell tissue and by formation of pathways in radial directions for release of liquids and vapours. This forms on the base of destroyed rays a great number of cavities disposed mainly in the radial-longitudinal planes of the wood. This wood modification increases the permeability in a zone 24 of the board 22 in FIG. 1. Water vapour was removed from the tunnel 12 by air flow.

After processing, the depth of the modified zone with increased permeability (marked with a dotted line in FIG. 1) was 13–16 mm, the wood moisture content is reduced to 75%. Following convectional kiln drying of the microwave pre-treated boards was 5 times faster compared with drying of non-modified timber. The "working side" of the board maintains high surface hardness.

The same process can be used as a pre-treatment to reduce shrinkage stresses in back-sawn lumber after drying. Microwave modification of the external shell of the board advantageously reduces board cupping (transverse warping).

EXAMPLE 2

This Example relates to the microwave pre-treatment of Messmate boards of cross section 45×120 mm for following fast drying in a convectional kiln. The boards must have minimum bending strength losses on the application of vertical load. Only the central region of the timber can be modified. Initial wood moisture content was 90%.

For microwave pre-treatment the board was placed on the conveyer belt 36 as shown on FIG. 2 and moved along the tunnel 30. Microwave energy was suppled to timber through four waveguide radiators 32 as shown by arrows 34. Process parameters: microwave frequency—2.45 GHz, electric field strength vector E orientation—perpendicular to wooden grain, average power intensity at every waveguide—970 W/cm$^2$, conveyor speed—2.5 mm/s. Microwave irradiation required to vaporise water contained in zones of the external shell of the wood and to create internal pressure in that zone of the wood was applied resulting in modification of wood structure by destroying ray cell tissue and by formation of pathways in radial directions for release of liquids and vapours. This forms on the base of destroyed rays a great number of cavities disposed mainly in radial-longitudinal planes of the wood. This wood modification increased the permeability in zones 40 of the board 38 in FIG. 2. Water vapour was removed from the tunnel 30 by air flow.

After processing the depth of the modified zones 40 with increased permeability (marked with dotted line in FIG. 2) was 13–15 mm and the wood moisture content was reduced to 70%. Subsequent convectional kiln drying of the microwave pre-treated boards was 10 times faster compared with drying of non-modified timber of the same cross section.

EXAMPLE 3

This Example relates to the microwave pre-treatment of Messmate lumber of cross section 90×90 mm for subsequent rapid drying in a convectional kiln. The block must have minimum bending strength losses on the application of vertical load. Initial wood moisture content was 90%.

For microwave pre-treatment the lumber was placed on the conveyer belt 48 as shown on FIG. 3 and moved along the tunnel 44. Microwave energy was suppled to the lumber through the waveguide radiators 46 and c58 as shown by arrows 54 and 56.

Process parameters of the first stage of the treatment (FIG. 3A) with waveguides 54: microwave frequency supplied in waveguides 54—2.45 GHz, electric field strength vector E orientation in waveguides 54—perpendicular to wooden grain, average power intensity 2,900 W/cm$^2$, conveyor speed—7 mm/s.

Process parameters of the second stage of the treatment (FIG. 3B) with waveguide 58: microwave frequency supplied in waveguide 58—0.922 GHz, electric field strength vector E orientation in waveguides 58—perpendicular to wooden grain, average power intensity 250 W/cm$^2$, conveyor speed is the same—7 mm/s.

Microwave irradiation required to vaporise water contained in zones in the external shell of the wood followed by irradiation to vaporise water contained in a central zone of the wood and to create internal pressure in the respective zones of the wood resulting in modification of the wood structure by destroying ray cell tissue and formation of pathways in radial direction for the release of liquids and vapours. This forms on the base of destroyed rays a great number of cavities disposed mainly in radial-longitudinal planes. This wood modification increased the permeability in zones 52 and 64 of the lumber 50 in FIG. 3. Water vapour was removed from the tunnel 44 by air flow.

Initially, the conveyor moves the lumber along the waveguides radiators 54 with high frequency—2.45 GHz (first stage of treatment). After this processing the depth of the modified zones 52 with increased permeability (marked with dotted lines in FIG. 3) was 20–25 mm. Subsequently, the lumber passes along the waveguide radiator 56 with lower frequency—0.922 GHz. During this second stage of the processing the microwave energy was concentration at the core of the lumber. The wood was modified in the central zone 64. The vapour release from zone 64 is facilitated through earlier modified zones 52. This two stage treatment advantageously prevents the formation of big checks in the timber during treatment. The wood moisture content was reduced to 60% after this two stage microwave irradiation.

Following convectional kiln drying process of the microwave pre-treated lumber was 40 times faster compared with drying of non-modified timber of the same cross section.

Throughout this specification and the claims which follow, unless the context requires otherwise, the word "comprise", or variations such as "comprises" or "comprising", will be understood to imply the inclusion of a stated integer or group of integers but not the exclusion of any other integer or group of integers.

The reference to any prior art in this specification is not, and should not be taken as, an acknowledgement or any form of suggestion that prior art forms part of the common general knowledge in Australia.

Those skilled in the art will appreciate that the invention described herein is susceptible to variations and modifications other than those specifically described. It is to be understood that the invention includes all such variations and modifications which fall within its spirit and scope. The invention also includes all of the steps, features, compositions and compounds referred to or indicated in this specification, individually or collectively, and any and all combinations of any two or more of said steps or features.

The invention claimed is:

1. A method of microwave treatment of wood with a moisture content (based on dry weight) of at least 12% for rapid drying and stress relief which includes determining an area of the wood that is not to be treated, selectively subjecting a surface of the wood outside said determined area to microwave radiation at a frequency (f) in the range of from about 0.1 to about 24 GHz thereby forming a modified wood zone in the exterior shell of the wood, said modified wood zone having increased permeability relative to the untreated wood, wherein a core volume of the wood is left untreated by microwave surface.

2. A method according to claim 1, wherein said microwave treatment results in zones of one or more of a low degree of modification including rupturing wooden cell pore membranes, resin melting and replacement in channels and partly rupturing ray cells, moderate degree of modification including rupturing wooden cell pore membranes, resin boiling and replacement, destroying tyloses (in hardwood species) and rupturing ray cells, high degree of modification including rupturing wooden cell pore membranes, resin boiling and replacement, destroying tyloses (in hardwood species), rupturing ray cells, rupturing main cell (traheids, libriform) walls and vessels and formation of cavities being primarily in radial-longitudinal planes of the wood.

3. A method according to claim 1, wherein a plurality of zones located in the exterior shell of the wood are treated by the microwave treatment.

4. A method according to claim 1, including subsequently treating a core volume of the wood with a microwave.

5. A method according to claim 4, wherein a frequency of from about 2.4 to 24 GHz is used for treatment of the zone(s) of the exterior shell and a frequency of from about 0.1 to 1.0 GHz is used to treat the core volume.

6. A method according to claim 4, wherein the electric field strength vector E is oriented parallel to the wood grains for irradiation of the exterior shell zone(s) and primarily perpendicular to the wood grains for irradiation of the core volume.

7. A method according to claim 4, wherein said treating of said core volume of said wood is with a microwave of a lower frequency compared to that used to treat the zone or zones of the exterior shell.

8. A method according to claim 1, wherein the wood is treated to provide alternating treated and untreated zones in the exterior shell of the wood along the length of the wood and across the width of the wood.

9. A method according to claim 1, wherein a microwave with a power intensity (p) from about 10 W/cm$^2$ to about 100 kW/cm$^2$ is applied to said wood for a duration of from about 0.05 to about 600 seconds to cause water in the zone(s) of the exterior shell of the wood to vaporise resulting in an internal pressure in the zone(s) of the wood such that the zones are modified.

10. A method according to claim 1, wherein the microwave applied to the exterior shell of the wood has a frequency of from about 2.4 to 24 GHz.

11. A method according to claim 1, wherein a microwave of frequency (f) and power intensity (p) in the range of from about f=0.4 GHz and p=12 kW/cm$^2$ to about f=10 Ghz and p=0.48 kW/cm$^2$.

12. A method according to claim 11, wherein a microwave of frequency (f) and power intensity (p) is from about f=1 GHz and p=6 kW/cm$^2$ to about f=6 GHz and p=1.0 kW/cm$^2$.

13. A method according to claim 1, wherein the duration of the microwave treatment within the defined frequency and power intensity ranges is from 0.05 to 600 seconds.

14. A method according to claim 13, wherein the duration of the microwave treatment is less than 250 seconds.

15. A method according to claim 13, wherein the duration of the microwave treatment is 0.1 to 600 seconds.

16. A method according to claim 13, wherein the duration of the microwave treatment is less than 100 seconds.

17. A method according to claim 13, wherein the duration of the microwave treatment is 1 to about 20 seconds.

18. A method according to claim 1, wherein the electric field strength vector E orientation is changed from parallel to wood grains to perpendicular to wood grains during the treatment.

19. A method according to claim 1, wherein method is performed at a wood temperature of about 80 to about 110° C.

20. A method according to claim 19, wherein the wood is heated by means of microwave energy.

21. A method according to claim 20, wherein the microwave energy is at a frequency range of about 0.1 to about 24 GHz with a power intensity of from about 0.1 to about 10 W/cm$^2$ for a period of from about 600 seconds.

22. A method according to claim 19, wherein method is performed at a wood temperature of about 90 to about 100° C.

23. A method according to claim 1, wherein during the microwave treatment, the surface of the wood is cooled using gas or air flow.

24. A method according to claim 23, wherein the surface of the wood is cooled using gas or air flow at speeds of not less than 1 m/sec.

25. A method according to claim 23, wherein the surface of the wood is cooled using gas or air flow at speeds of not less than 2 m/sec.

* * * * *